United States Patent [19]

Okutomi et al.

[11] Patent Number: 4,777,335

[45] Date of Patent: Oct. 11, 1988

[54] CONTACT FORMING MATERIAL FOR A VACUUM VALVE

[75] Inventors: Tsutomu Okutomi; Seishi Chiba, both of Yokohama; Mikio Okawa, Tama; Tadaaki Sekiguchi, Yokohama; Hiroshi Endo, Yokohama; Tsutomu Yamashita, Yokohama, all of Japan

[73] Assignee: Kabushiki Kaisha Toshiba, Kawasaki, Japan

[21] Appl. No.: 4,904

[22] Filed: Jan. 20, 1987

[30] Foreign Application Priority Data

Jan. 21, 1986 [JP] Japan ..... 61-10486

[51] Int. Cl.[4] ..... C22C 9/00; H01H 1/02; H01H 33/66

[52] U.S. Cl. ..... 200/264; 420/469; 420/494; 420/495; 420/501; 420/580; 420/587; 75/72; 75/73; 200/144 B; 200/265; 200/266

[58] Field of Search ..... 200/262, 263, 264, 265, 200/266, 267, 268, 269, 144 B; 420/469, 492, 428, 494, 580, 501, 587, 502, 494, 495; 75/72, 83

[56] References Cited

U.S. PATENT DOCUMENTS

| | | | |
|---|---|---|---|
| 2,842,438 | 7/1958 | Saarivirts et al. | 75/153 |
| 3,437,479 | 4/1969 | Nakajima | 420/457 |
| 3,502,465 | 3/1970 | Nakajima | 420/496 |
| 3,592,987 | 7/1971 | Lempert et al. | 200/264 X |
| 3,627,963 | 12/1971 | Lindsay | 200/268 |
| 3,818,163 | 6/1974 | Robinson | 200/144 B |
| 3,821,505 | 6/1974 | Wood | 200/144 B |
| 4,032,301 | 6/1977 | Hassler et al. | 200/264 X |
| 4,048,117 | 9/1977 | Emmerich | 200/262 X |
| 4,088,475 | 5/1978 | Tyler et al. | 200/264 X |
| 4,153,755 | 5/1979 | Rothkegel et al. | 200/264 X |
| 4,503,010 | 3/1985 | Kippenberg et al. | 419/27 |
| 4,575,451 | 3/1986 | Naya et al. | 420/489 |
| 4,589,930 | 5/1986 | Kumagai | 148/11.5 C |

FOREIGN PATENT DOCUMENTS

| | | | |
|---|---|---|---|
| 2357333 | 5/1975 | Fed. Rep. of Germany | 200/264 |
| 41-12131 | 7/1966 | Japan . | |
| 44-23751 | 10/1969 | Japan . | |
| 59-25903 | 2/1984 | Japan . | |
| 61-227330 | 10/1986 | Japan . | |
| 440707 | 7/1972 | U.S.S.R. | 200/264 |
| 2123852 | 2/1984 | United Kingdom | 200/264 |

*Primary Examiner*—Henry J. Recla
*Assistant Examiner*—Ernest G. Cusick
*Attorney, Agent, or Firm*—Foley & Lardner, Schwartz, Jeffery, Schwaab, Mack, Blumenthal & Evans

[57] ABSTRACT

A contact forming material for a vacuum valve or vacuum circuit breaker comprising (a) a conductive material consisting of copper and/or silver, and (b) an arc-proof material consisting of chromium, titanium, zirconium, or an alloy thereof wherein the amount of said arc-proof material present in said conductive material matrix is no more than 0.35% by weight. This contact forming material is produced by a process which comprises the steps of compacting arc-proof material powder into a green compact, sintering said green compact to obtain a skeleton of the arc-proof material, infiltrating the voids of said skeleton with a conductive material, and cooling the infiltrated material. The contact forming material can provide contacts for a vacuum valve or vacuum circuit breaker which has excellent characteristics such as temperature rise characteristic and contact resistance characteristic.

7 Claims, 1 Drawing Sheet

CONTACT FORMING MATERIAL FOR A VACUUM VALVE

BACKGROUND OF THE INVENTION

This invention relates to a vacuum valve (a vacuum circuit breaker), and, more particularly, to an alloy material which can be used as contacts in the vacuum valve.

Principal characteristics required for a contact forming material for a vacuum valve are welding-resistance, voltage withstanding capability, and current interrupting property. Important requirements other than these fundamental requirements are low and stable temperature rise and low and stable contact resistance. However, these requirements contradict each other and therefore it is impossible to meet all of the requirements by a single metal. Accordingly, in many alloy material which have been practically used, at least two elements which compensate mutually inadequate performance thereof have been used in combination to develop alloy materials which are suitable for specific uses at a large current, at a high voltage or at other conditions. Alloy materials having excellent characteristics have been developed. However, demands for a contact forming material for a vacuum valve which withstands higher voltage and larger current have increased, and a contact forming material for the vacuum valve which entirely meets such requirements has not been obtained.

For example, Japanese Patent Publication No. 12131/1966 discloses a Cu-Bi alloy containing no more than 5% of an anti-welding component such as Bi. This reference describes that the Cu-Bi alloy can be used as a contact forming material which is used at a large current. However, the solubility of Bi in the Cu matrix is extremely low, and therefore segregation occurs. Further, the surface roughening after current interruption is large and it is difficult to carry out processing or forming. Japanese Patent Publication No. 23751/1969 discloses the use of a Cu-Te alloy as a contact forming material which is used at a large current.

While this alloy alleviates the problems associated with the Cu-Bi alloy, it is more sensitive to an atmosphere as compared with the Cu-Bi alloy. Accordingly, the Cu-Te alloy lacks the stability of contact resistance or the like. Furthermore, although both the contacts formed from the Cu-Te alloy and those from the Cu-Bi alloy have excellent anti-welding properties in common and can be used sufficiently in prior art moderate voltage fields in respect to voltage withstanding capability, it has turned out that they are not necessarily satisfactory in applying to higher voltage fields.

On the other hand, a known contact forming material which is used at a high voltage is a sintered alloy of Cr and a highly conductive component such as Cu (or Ag). However, Cr is a metal which is extremely readily oxidized and therefore, of course, the management of Cr powder or its compact is important. Atmospheres which are used during preliminary sintering and during infiltration affect the characteristics of the material. For example, in the practical manufacturing process, even in the case of the Cu-Cr alloy obtained by thoroughly controlling the preliminary sintering temperature and time, and the infiltration temperature and time, the contact resistance of temperature rise characteristics vary and are unstable. Contacts having stability without scattering are required.

SUMMARY OF THE INVENTION

Accordingly, it is an object of the present invention to provide a contact forming material for a vacuum valve capable of stabilizing both the contact resistance characteristic and temperature rise characteristic.

The results of our studies have demonstrated that the above instability of the Cu (Ag)-Cr, Cu-Ti and Cu-Zr contact forming materials depends upon (1) the variation of the composition of Cu (Ag)-Cr, Cu-Ti, and Cu-Zr alloys, (2) the particle size, particle size distribution and degree of segregation of Cr, Ti and Zr particles, and (3) the degree of porosity present in the alloys. We have found that the problems are effectively solved by the selection of the Cr, Ti and Zr raw materials and the control of the sintering technique.

However, the results of our studies have now demonstrated that satisfactory stability is not entirely obtained by the selection of the raw materials and the control of the sintering technique. We have examined the influence of the amount of other principal elements such as Cr, Ti and Zr contained in the Cu (Ag) matrix of the alloy. That is, according to our discovery, it is not entirely satisfactory to note the total amount (from 20% to 80% by weight) of Cr, Ti and Zr contained in the alloy. We have found the new fact that the amount of arc-proof components such as Cr, Ti and Zr present in the conductive material matrix such as Cu or Ag in a minor amount is extremely important in the stabilization of both the contact resistance characteristic and the temperature rise characteristic.

A contact forming material according to the present invention comprises:

(a) a conductive material consisting of copper and/or silver, and (b) an arc-proof material consisting of at least one of chromium, titanium and zirconium or an alloy of said metal and at least one other metal, wherein the amount of said arc-proof material present in said conductive material matrix is no more than 0.35% by weight.

Further, a process for producing a contact forming material for a vacuum valve or vacuum circuit breaker according to the present invention comprises the steps of:

(1) compacting arc-proof material powder into a green compact;

(2) sintering said compact to obtain a skeleton of the arc-proof material;

(3) infiltrating the voids of said skeleton with a conductive material; and (4) cooling the infiltrated material, wherein said cooling is carried out by at least one of the following methods:

(i) a method wherein the infiltrated material is cooled by setting the cooling rate used between a specific temperature difference within a cooling temperature range of the cooling step, at a specific value to decrease the temperature rise phenomenon of said contact forming material for the vacuum valve;

(ii) a method wherein the infiltrated material is retained at a specific temperature within said cooling temperature range for a period of time which increases the conductivity of said contact forming material for the vacuum valve; and (iii) a method wherein the infiltrated material is reheated at a reheating temperature within said cooling temperature range for a period of time which increases the conductivity of said contact forming material for the vacuum valve after the cooling step is completed.

DESCRIPTION OF THE PREFERRED INVENTION

Figure 1:
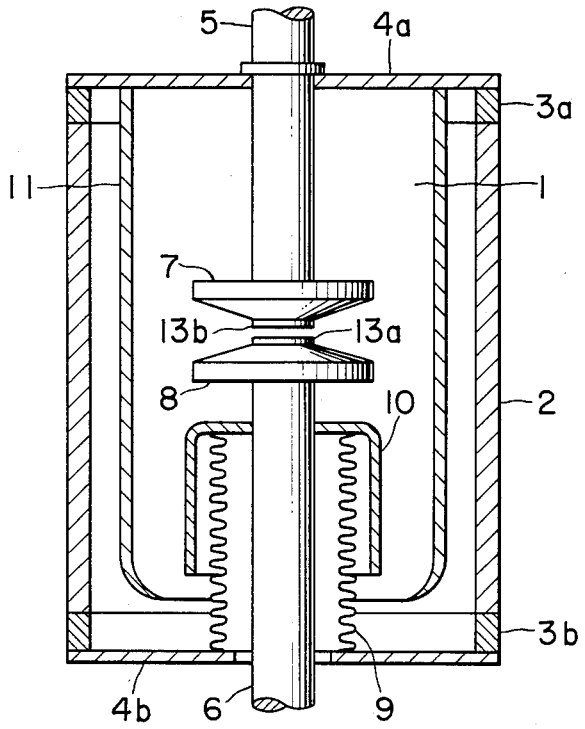
FIG. 1 is a sectional view of a vacuum circuit breaker to which a contact forming material of the present invention is applied.

Raw materials which are used in the present invention comprise an arc-proof material consisting of at least one of thoroughly degassed and surface-cleaned Cr, Ti and Zr powders, and a conductive material consisting of both or either of Cu and Ag. In addition to Cr, Ti, Zr, Cu and Ag, no more than about 10% of an anti-welding material such as Te, Bi or Sb, and an arc-proof material such as W, Mo or V can be added as auxiliary components according to the uses of the contacts. If the particle size of the Cr, Ti and Zr powders is more than 250 micrometers, the probability of contacting pure Cu or Ag portions with each other will become high and the larger particle size is undesirable due to a welding problem. The lower limit of the particle size is not present from the standpoint of achieving the effect of the process of the present invention. The lower limit of the particle size is determined from the standpoint of handling to prevent the increase of its activity and instability.

The Cu raw material is obtained by grinding and sieving, for example, electrolized Cu in an inert atmosphere such as argon gas. The Cr, Ti, Zr raw materials used contain a minimum amount of admixed impurities such as Si and Al. Preferably, the total amount of such impurities is no more than 1,000 ppm.

According to our discovery, the amount of Cr (or Ti or Zr) in the Cu and/or Ag matrices of the alloy depends upon (1) Cr (or Ti or Zr) which is originally contained in the Cu raw material used, and (2) Cr (or Ti or Zr) introduced into Cu and/or Ag from Cr (or Ti or Zr) which is another principal component. Accordingly, in the present invention, in order to decrease the amount of Cr (or Ti, or Zr) in the matrix, the following procedures can be used. With respect to the former (1), Cu and/or Ag raw materials having a minimum amount of impurity elements can be utilized. Alternatively, usual Cu and/or Ag raw materials can be previously subjected to zone melting to purify the raw materials. With respect to the latter (2), the use of lower temperature of high temperature treatment during the alloying step of Cu (and/or Ag) and Cr (or Ti or Zr), or the use of shorter time is effective. Alternatively, it is effective to reasonably control the cooling step after the alloying step.

The amount of the arc-proof material present in the conductive material matrix of the alloy in the form of a solid solution is no more than 0.35% by weight, preferably from 0.01% to 0.35% by weight. If the amount of the arc-proof material is more than the upper limit, the characteristics of the contacts of the vacuum valve (temperature rise characteristic and contact resistance characteristic) will become unstable. It is difficult to produce a contact forming material wherein the amount of the arc-proof material in the conductive material matrix is less than the lower limit.

The ultimately obtained contact forming material contains preferably from 80% to 20% by weight of the conductive component and from 20% to 80% by weight of the arc-proof component. If the amount of the arc-proof component in the contact forming material is more than 80%, joule welding will often occur. Such a welding is undesirable for surface roughening which is correlated with restrike, and it is difficult to interrupt a current of 40 KA at a voltage of 7.2 KV. If the amount of the arc-proof component is less than 20%, arc-proof property will not be maintained when the voltage of, for example, 40 KV is interrupted. This will exhibit undesirable large arc consumption.

Another Embodiment (1)

In this embodiment, the arc-proof material comprises a Cr-base alloy containing no more than 50% by weight of Fe and/or Co, and the balance being Cr.

Raw materials which are used in this embodiment comprise an arc-proof material consisting of thoroughly degassed and surface-cleaned Cr as well as Fe and/or Co, and a conductive material consisting of Cu and/or Ag. In addition to Cr, Cu, Ag, Fe, and Co, no more than about 10% of an anti-welding material such as Te, Bi or Sb can be added as an auxiliary component according to the uses of the contacts. If the particle size of Cr, Fe and Co is more than 250 micrometers, the probability of contacting pure Cu and/or Ag portions with each other will become high, and the larger particle size is undesirable from the standpoint of anti-welding property. The lower limit of the particle size is not present from the standpoint of achieving the effect of the present invention. The lower limit of the particle size can be determined from the standpoint of handling to prevent the increase of its activity.

The contact forming alloy can be obtained by a method wherein heating is completed at the melting point of Cu and/or Ag or lower temperatures, or by a method wherein heating is carried out at the melting point of Cu and/or Ag or higher temperatures and infiltration is carried out. In any method, it is extremely important to control the amount of Cr in the Cu and/or Ag phases of the alloy in order to achieve the above object of the present invention.

On the other hand, when the skeleton comprises Cr containing Fe and/or Co, or when a small amount of Cu and/or Ag is previously incorporated in the Cr containing Fe and/or Co, the resulting contact forming materials of the present invention exhibit similar effects.

It is preferable to use the Cu raw material obtained by grinding and sieving, for example, electrolyzed Cu in an inert atmosphere such as argon gas.

It is preferable to use Cr, Fe, and Co raw materials containing a minimum amount of admixed impurities such as Al, Si and Ca.

Further Embodiment (2)

In this embodiment, the arc-proof material comprises a Cr-base alloy containing no more than 50% by weight of at least one metal selected from Mo, W, V, Nb and Ta, and the balance being Cr.

The preparation of the raw materials in this embodiment is the same as that in the embodiment (1) described above.

Mo, W, V, Nb and Ta which can be additionally added are efffective for the improvement of the voltage withstanding characteristic of the Cr-base alloy.

Process

A process for producing a contact forming material for a vacuum valve according to the present invention will now be described.

The following description of each step is primarily directed to the use of Cr as an arc-proof component. Of course, in the cases of the use of Ti and Zr as the arc-proof component, the same steps can be used. In the following description, Cu and/or Ag as the conductive material components are simply described as Cu for convenience in some cases.

Compacting

A green compact is compacted from the Cr powder as the arc-proof material under an external pressure of no more than 8 metric tons per square centimeter or a pressure due to its own weight.

The compacting pressure used in obtaining the green compact is a factor which determines the amount of Cr in the Cu-Cr alloy.

The amount of Cr in the Cu (and/or Ag)-Cr alloy can be selected within the range of from 20% to 80% by weight. The compacting pressure therefor is no more than 8 tons per square centimeter, preferably no more than 7.5 tons per square centimeter, and more preferably no more than 7 tons per square centimeter. If the compacting pressure is more than 8 tons per centimeter, the amount of Cr after infiltration will be more than 80% and therefore will be outside of the purview of the present invention. In order to ensure a large amount of Cr close to 80%, pure Cr as well as Cu-containing Cr can be used as a skeleton. On the other hand, in order to ensure a small amount of Cr close to 20%, pure Cr cannot be used as the skeleton. An alloy containing such a small amount of Cr is obtained by utilizing a Cr+Cu powder mixture which is obtained by mixing an appropriate amount of Cr into Cr. In this case, the compacting pressure can be established at an any pressure of no more than 8 tons per square centimeter according to the amount of the Cu powder used.

If the compacting pressure is more than 8 tons per square centimeter, cracks can occur in the compact during the heating process, and therefore such a compacting pressure is undesirable.

Sintering

The thus obtained compact is placed in a heating furnace together with a vessel for sintering and sintered. It is necessary that the sintering atmosphere be a nonoxidizing atmosphere. Examples of such nonoxidizing atmospheres are a vacuum and hydrogen gas. Of these atmospheres, a vacuum (at least $1\times10^{-5}$ Torr) atmosphere is suitable from the standpoint of removing oxygen and nitrogen occluded in packed Cr powder, pressed compacts, vessels and the like.

The sintering temperature and sintering time used affect the density of the skeleton which is a sintered body, in other words, porosity of the skeleton. For example, in order to obtain a weight ratio of the Cr skeleton to the amount of Cu infiltrated into its voids of about 50:50, the porosity is desirably from 40% to 50%, the sintering temperature is preferably from 800° to 1050° C., more preferably from 900° to 950° C., and the sintering time is preferably from 0.25 to 2 hours, more preferably from 0.5 to 1 hour. The conditions described above can vary depending upon the ratio of the Cr to the Cu.

Infiltration

Cu and/or Ag which are infiltrating agents are placed on the upper surface and/or lower surface of the resulting skeleton, and the whole is heated, for example, in vacuo (from $1\times10^{-4}$ to $1\times10^{-6}$ Torr) to infiltrate Cu and/or Ag into the voids of the skeleton.

The infiltration temperature is a temperature of no less than the melting point of Cu and/or Ag. In the case of Cu, an infiltration temperature of from 1,100° C. to 1,300° C. is suitable and, in the case of Ag, an infiltration temperature of from 1,000° to 1,100° C. is suitable. The infiltration time is set at a time sufficient to completely impregnate the voids of the skeleton with the melt of the infiltrating agent.

Brazeability of the resulting contact forming alloy (in silver brazing it to a conductive rod or an electrode) can be improved by simultaneously forming a layer of infiltration metal on at least a portion of the surface of the skeleton in the filtration step described above.

Cooling

The alloy material infiltrated in the step described above is cooled so as to adjust its conductivity and temperature rise characteristic.

The cooling conditions after sintering and infiltration are a factor which determines the fundamental characteristics, particularly conductivity of the Cu-Cr alloy material, and this is one of the features of the process of the present invention.

Cr is a metal which is extremely readily oxidized, and therefore, needless to say, the control of the raw powders or compact is important. The conditions of the atmosphere used in the sintering and infiltration steps affect the characteristics of the material.

However, even in the case of Cu-Cr alloys obtained by carefully controlling the temperature and time used in the sintering and infiltration steps, the specific resistance, contact resistance or temperature rise characteristics exhibit scattering and instability. Cu-Cr alloys exhibiting no scattering and having stability are desired.

The results of our studies have demonstrated that the above instability of the Cu-Cr contact forming material depends upon (1) the variation of the composition of the Cu-Cr alloy, (2) the particle size, particle size distribution and degree of segregation of Cr particles, (3) the degree of porosity in the alloys and (4) the quality of the Cr raw material. We have found that the problems are effectively solved by the selection of the Cr raw material and the control of the sintering technique. In order to more greatly improve the stability, it proved to be necessary to strictly control the sintering technique in addition to (1), (2), (3) and (4) described above.

We have now found that the instability of the characteristics mentioned above is correlated with the difference in the amount of Cr slightly contained in Cu. When the amount of Cr contained in the Cu portion of the Cu-Cr alloy is estimated by a semi-quantitative method (X-ray microanalysis), Cu-Cr alloys exhibiting unstable characteristics generally showed a scattering within the range of from 0.2 to 0.5% by weight, whereas Cu-Cr alloy exhibiting stable characteristics obtained by the technique of the present invention showed a scattering of no more than 0.2%, representatively no more than 0.1%. We have observed that this difference is dependent upon the heating history of the Cu-Cr alloy, particularly after sintering or infiltration.

Further, we have found that the conductivity of the Cu-Cr alloy is improved and its scattering width is reduced by strictly controlling the conditions. The heating history after sintering or infiltration as used herein can be represented by characteristics of the cooling rate to which the contacts per se are substantially subjected. By the heating history is meant the process for controlling the cooling rate which varies with the size of the contacts and the characteristics of the furnace.

Examples of cooling which improve the temperature rise characteristic and conductivity of the Cu-Cr alloy will now be described.

Cooling of the material obtained in the infiltration step described above is preferably carried out at a cooling rate of from 0.6° to 6° C. per minute to reduce the temperature at least 100° C. within a temperature range of from 800° C. to 400° C. If the cooling rate is less than 0.6° C. per minute, conductivity characteristic deterioration will not occur, but the production time will be increased, and thus such a cooling rate is economically disadvantageous. If the cooling rate is more than 6° C. per minute, the amount of Cr which is present in the Cu phase of the Cu-Cr alloy in the form of a solid solution will increase. This leads to a reduction of the conductivity whereby such a higher cooling rate is undesirable. For example, if the amount of Cr in the Cu phase of a Cu-50% Cr alloy is more than about 0.5%, its conductivity will be one half that of an alloy wherein the amount of Cr in the Cu phase is 0.1%. (In the case of 0.1%, the conductivity is 40% IACS, whereas in the case of 0.5%, the conductivity is 20% IACS or lower.)

In an alternative example of the cooling step of the process of the present invention, an inert gas is sprayed to cause quenching from 400° C. to room temperture. Generally, the time necessary for cooling over the range described above is determined by the heat capacity of the furnace or the sample, etc., and it takes a long period of time. Therefore, the production efficiency can be improved by quenching.

In the cooling step of the process of the present invention, at least one heating retention is carried out for at least 0.25 hour at any temperture selected in the temperature range of from 800° C. to 400° C. Further, the above-mentioned effect can be obtained by an alternative method in which the heating retention is carried out after cooling has been completed. The heating retention can also facilitate the regeneration (the recovery and improvement of its conductivity) if contacts exhibiting inferior characteristics, particularly conductivity, are discovered after sintering and infiltration have been completed.

Anti-reaction Member

In the sintering and infiltration steps described above, it is preferable that anti-reaction member be interposed between the compact and the vessel for sintering, and between the skeleton and the vessel for infiltration in order to reduce the reaction between the members and/or wetting. The characteristics of the alloy can be much improved by preventing the reaction and/or wetting as described above.

It is desirable that such anti-reaction members comprise at least one particulate or fibrous heat-resistant inorganic material selected from $Al_2O_3$ and $SiO_2$ preheated at a temperature of at least 400° C. For example, the anti-reaction member can be composed of fibrous ceramics.

In another preferred embodiment of the invention, the anti-reaction member can be composed of a bundle of ceramic fibers.

Treatment Atmosphere

Treatment in each step described above is preferably carried out in a nonoxidizing atmosphere, particularly in an inert gas such as argon gas, $H_2$ gas, $N_2$ gas, or in vacuo.

Vacuum Valve

An example of a vacuum valve (a vacuum circuit breaker) in which the contact forming material according to the present invention is used will now be described with reference to attached drawings.

Figure 2:
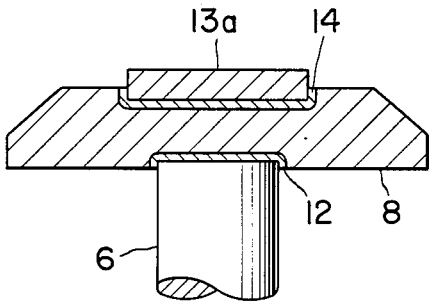
FIG. 2 is an enlarged sectional view of one of the contacts of the vacuum circuit breaker shown in FIG. 1.

FIG. 1 shows an example of a vacuum circuit breaker to which the contact forming material according to the present invention is applied. In FIG. 1, reference numeral 1 shows an interruption chamber. This interruption chamber 1 is rendered vacuum-tight by means of a substantially tubular insulating vessel 2 of an insulating material and metallic caps 4*a* and 4*b* disposed at its two ends via sealing metal fittings 3*a* and 3*b*. A pair of electrodes 7 and 8 fitted at the opposed ends of conductive rods 5 and 6 are disposed in the interruption chamber 1 described above. The upper electrode 7 is a stationary electrode, and the lower electrode 8 is a movable electrode. The electrode rod 6 of the movable electrode 8 is provided with bellows 9, thereby enabling axial movement of the electrode 8 while retaining the interruption chamber 1 vacuum-tight. The upper portion of the bellows 9 is provided with a metallic arc shield 10 to prevent the bellows 9 from becoming covered with arc vapor. Reference numeral 11 designates a metallic arc shield disposed in the interruption chamber 1 so that the metallic arc shield covers the electrodes 7 and 8 described above. This prevents the insulating vessel 2 from becoming covered with the arc vapor. As shown in FIG. 2 which is an enlarged view, the electrode 8 is fixed to the conductive rod 6 by means of a brazed portion 12, or pressure connected by means of a caulking. A contact 13*a* is secured to the electrode 8 by brazing as at 14 or pressure connected by means of a caulking. Reference numeral 13*b* in FIG. 1 designates a contact of the stationary electrode 7.

The contact forming material of the present invention is adapted for constituting the contacts 13*a* and/or 13*b* as described above.

In order to indicate more fully the nature and utility of this invention, the following examples are set forth, it being understood that these examples are presented as illustrative only and are not intended to limit the scope of the ivnention.

The measurement of the contact resistance characteristic, the temperature rise characteristic and the amount of the arc-proof component in each example was carried out as follows.

Measurement of Contact Resistance Characteristic

The contact resistance characteristic was measured as follows. A flat electrode having a diameter of 50 mm and having a degree of surface roughness of 5 micrometers and a convex electrode having a curvature radius of 100 R and having the same degree of a surface roughness as that of the flat electrode are oppposed. The two electrodes are mounted onn an electrode-mountable $10^{-5}$ Torr vacuum vessel having a make-and-break mechanism. A load of 3 kg is applied thereto. The contact resistance is determined from the fall of potential obtained when an alternating current of 10 A is applied to the two electrodes. The value of contact resistance is a value including, as a circuit constant, the resistance or contact resistance of a wiring material, a switch and a meter from which a measurement circuit is produced.

The value of contact resistance includes the resistance of the axial portion of a mountable vacuum switchgear per se of from 1.8 to 2.5$\mu\Omega$, and the resistance of the coil portion for the generation of the magnetic field of from 5.2 to 6.0$\mu\Omega$, and the balance is a value of the portion of contacts (the resistance and contact resistance of the contact forming alloy).

Measurement of Temperature Rise Charactreristic

The temperature rise characteristic was measured as follows. The same electrodes as those described above were opposed and the maximum temperature obtained when a current of 400 A was continuously passed through a $10^{-5}$ Torr vacuum vessel for one hour under a contact force of 500 kg was determined at the movable axial portion. The temperature includes the ambient temperature of about 25° C. The value of temperature rise is a comparative value including the influence of the heat capacity of a holder on which the electrodes are mounted.

Measurement of Amount of Arc-proof Material present

The amount of the arc-proof material contained in the conductive material (Cu and/or Ag) matrix of the contact forming material was determined under the following conditions. The amount of the arc-proof material present in a Cu-Cr alloy was measured as follows. The amount of the arc-proof material present in alloys other than Cu-Cr alloy was measured in substantially the same procedure as that used in the Cu-Cr alloy. The Cu-Cr alloy is illustrated as a representative example herein.

A Cu-Cr alloy was formed into chips, and one gram of the Cu-Cr alloy was placed in a breaker. Fifty mililiters of 3N nitric acid were added and the mixture was heated for 30 minutes at a temperature of 100° C. After cooling, the solution was filtered and the undercomposed Cr grain and the Cu phase were separated. The filtrate was diluted with distilled water to prepare a solution for the determination of impurities in the Cu phase. This solution was determined under the conditions shown in the following Table 1 by inductive coupling plasma emission spectroscopy.

TABLE 1

| Measurement Conditions of Inductive Coupling Plasma Emission Spectroscopy | |
|---|---|
| Frequency | 27.12 MHz |
| High-frequency output | 1.3 kW |
| Cooling gas | 16.5 liters per min. |
| Nebulizer gas | 0.4 liter per min. |
| Plasma gas | 0.8 liter per min. |

TABLE 1-continued

| Measurement Conditions of Inductive Coupling Plasma Emission Spectroscopy | |
|---|---|
| Measurement wavelength for Cr | 267.7 nm |

EXAMPLE A-1

Cr having an average particle size of 125 micrometers was compacted under a pressure of 2 tons per square centimeter into a green compact, and the compact was placed in a carbon vessel. Preliminary sintering was carried out for one hour in vacuo at a temperature of 1,000° C. A Cu infiltrating agent was placed on the lower surface of the preliminary sintered body. An infiltration step was carried out for one hour in vacuo at a temperature of 1,200° C. After the infiltration step was completed, the contact forming material was cooled from 1,200° C. to obtain a Cu-49.7%Cr alloy.

The amount of Cr contained in the Cu matrix of the Cu-49.7%Cr alloy was measured to be 0.01% by weight.

The alloy material was processed into a specific contact shape, and the contacts were mounted on a mountable testing device. The temperature rise characteristic and contact resistance characteristic were evaluated.

The results are shown in Table 2.

EXAMPLES A-2 THROUGH A-14 AND COMPARATIVE EXAMPLES A-1 AND A-2

Contact forming alloys containing conductive materials and arc-proof materials shown in Table 2 were produced and tested as in Example 1.

The results are shown in Table 2.

TABLE 2

| Exam. No. and Comp. Exam. No. | Materials used: Composition of contact forming alloy (wt. %) | Kind and Amount of arc-proof material (Cr, Ti or Zr) contained in conductive material (Cu or Ag) matrix of contact forming alloy: Kind | Amount (wt. %) | Evaluation Result: Temperature Rise Characteristic (°C.) | Contact Resistance Characteristic (μΩ) |
|---|---|---|---|---|---|
| Exam. A-1 | Cu—49.7Cr | Cr | 0.01 | 49.1 | 10.2–13.3 |
| Exam. A-2 | Cu—50.6Cr | Cr | 0.08 | 52.2 | 10.1–13.0 |
| Exam. A-3 | Cu—49.1Cr | Cr | 0.15 | 56.5 | 12.5–14.6 |
| Exam. A-4 | Cu—49.5Cr | Cr | 0.35 | 64.2 | 14.1–16.2 |
| Comp. Exam. A-1 | Cu—50.4Cr | Cr | 0.49 | 73.6 | at least 25 |
| Exam. A-5 | Cu—61.4Cr | Cr | 0.32 | 67.0 | 15.2–18.8 |
| Exam. A-6 | Cu—79.6Cr | Cr | 0.30 | 69.1 | 18.4–20.0 |
| Comp. Exam. A-2 | Cu—92.4Cr | Cr | 0.33 | 94.5 | at least 35 |
| Exam. A-7 | Cu—43.7Ti | Ti | 0.17 | 62.6 | 13.4–14.9 |
| Exam. A-8 | Cu—46.2Zr | Zr | 0.15 | 63.8 | 14.7–15.7 |
| Exam. A-9 | Ag—49.2Cr | Cr | 0.15 | 51.0 | 10.2–10.6 |
| Exam. A-10 | Ag—49.8Ti | Ti | 0.16 | 53.2 | 11.1–12.2 |
| Exam. A-11 | Ag—50.7Zr | Zr | 0.15 | 54.6 | 12.1–13.0 |
| Exam. A-12 | Cu—20Cr | Cr | 0.18 | 40.5 | 7.7–8.8 |
| Exam. A-13 | Cu—49.1Cr—0.17Bi | Cr | 0.14 | 59.1 | 13.1–14.7 |
| Exam. A-14 | Cu—48.3Cr—2.7Te | Cr | 0.16 | 60.3 | 13.8–15.2 |

As can be seen from Table 2, the temperature rises with increasing the amount of Cr in the Cu matrix. In particular, when the amount of Cr in the Cu matrix is no more than 0.35% (Examples A-1 through A-4), the value of the temperature rise of the movable axial portion is no more than 70° C. In contrast, when the amount of Cr in the Cu matrix is 0.49% (Comparative Example A-1), the value of the temperature rise exceeds 70° C. While it is difficult to provide the strict explanation which shows the fact that the critical value of value of the temperature rise is 70° C., the assembly-type switchgear used in this experiment has thermal constitution extremely similar to a conventional vacuum valve (such as the disposition of members and heat capacity) and a certain correspondence is obtained. Such a value can be used as a criterion. That is, in the conventional vacuum valve, the temperature rise of 65° C. is regarded as a criterion. According to experimental conversion, the value of temperature rise of 70° C. of the present detachable switchgear corresponds approximately to it.

The tendency described above is exhibited by the contacts wherein the total amount of Cr in the Cu-Cr alloy is about 50%. Even if the amount of Cr is 61.4% (Example A-5) or 79.6% (Example A-6), the stable temperature rise characteristic is observed when the amount of Cr in the Cu matrix is within about 0.35%. In the case of contacts wherein the total amount of Cr in the Cu-Cr alloy is 92.4%, the stable temperature characteristic cannot be ensured even if the amount of Cr in the Cu matrix is no more than 0.35% (Comparative Example A-2). When the amount of Cr in the Cu matrix is no more than 0.35% (Example A-1 through A-6), the low value of contact resistance is maintained. In Comparative Example A-1 wherein the amount of Cr is more than 0.35% and in Comparative Example A-2 wherein the total amount of Cr is more than 80%, the contact forming materials exhibit high contact resistance characteristic.

The foregoing is the description with respect to the Cu-Cr alloy. By observing the ideal that the amount of the arc-proof material in the conductive material matrix is controlled within the constant value, similar effects can be obtained even in the cases of a Cu-Ti alloy (Example A-7) and a Cu-Zr alloy (Example A-8) when the amount of the arc-proof material is within 0.35%. When the highly conductive material is Ag, similar effects can be obtained (Examples A-9 through A-11). Similar effects with respect to the temperature rise characteristics can be also obtained with respect to the contact resistance (Examples A-7 through A-11).

In the cases of contact forming alloys containing Bi (Example A-13) or Te (Example A-14) as the anti-welding component, similar effects can be obtained.

When the total amount of Cr, Ti or Zr in the Cu-Cr, Cu-Ti or Cu-Zr alloy is small, the high conductivity and low hardness characteristic are maintained and therefore the temperature rise characteristic and contact resistance characteristic are good without any problem as shown in Example A-12 wherein the Cu-Cr alloy is used. In many cases, the lower limit of the arc-proof material is determined by other properties such as consumption resistance, welding-resistance and current interrupting property.

It is apparent from the above description that the upper limit of the amount of the arc-proof material (Cr in the case of the Cu-Cr alloy) in the conductive material matrix (Cu in the case of the Cu-Cr alloy) is 0.35%.

EXAMPLES B-1 THROUGH B-12 AND COMPARATIVE EXAMPLES B-1 THROUGH B-4

First, as pretreatment for producing a contact forming alloy, mixture of Cr having an average particle size of 125 micrometers and Co and/or Fe having an average particle size of 1 to 3 micrometers are compacted under a pressure of 2 tons per square centimeter into a green compact, and the compact is placed in a carbon vessel. Preliminary sintering is carried out for one hour in vacuo at a temperature of 1,000° C. A Cu infiltrating agent is placed on the lower surface of the preliminary sintered body. An infiltration step is then carried out for one hour in vacuo at a temperature of 1,200° C. After the infiltration step is completed, the contact forming alloy material is cooled from 1,200° C.

In the Cu-Cr-base contact forming materials (Cu-Cr-Co) containing about 40% by weight of Cr and about 10% by weight of Co, the amount of Cr in the Cu phase was varied. Each of the Cu-Cr-base contact forming materials was processed into a specific contact shape, and then each alloy sample was mounted on the mountable testing device described above and subjected to the current-passing test under the specific conditions described above. As can be seen from the results shown in the following Table 3, the temperature rises with increasing the amount of Cr in the Cu phase. In particular, when the amount of Cr in the Cu phase is no more than 0.35% (Examples B-1 through B-4), the value of the temperature rise of the movable axial portion is no more than 70° C. In contrast, when the amount of Cr in the Cu phase is 0.52% (Comparative Example B-2), the value of the temperature rise exceeds 70° C. (Table 3). While it is difficult to provide the strict explanation which shows the fact that the critical value of the temperature rise is 70° C., the assembly-type switchgear used in this experiment has thermal constitution extremely similar to a conventional vacuum valve (such as the deposition of members and heat capacity) and it can be considered that a certain correspondence is obtained. That is, in the conventional vacuum valve, the temperature rise of 65° C. is regarded as a criterion. According to experimental conversion, the value of the temperature rise of 70° C. of the present mountable switchgear corresponds approximately to it.

The tendency described above is exhibited by the contacts wherein the total amount of Cr in the Cu-Cr-base contact forming material is about 40%. Even if the amount of Cr is 51.6% an the amount of Co is about 10% (Example B-5) or even if the amount of Cr is 68.2% and the amount of Co is about 10% (Example B-6), the stable temperature rise characteristic is observed when the amount of Cr in the Cu phase is within 0.35%. In contrast, in the case of a contact forming alloy wherein the total amount of Cr in the Cu-Cr-base contact forming material is 81.9% and wherein the amount of Co is about 10%, the stable temperature characteristic cannot be ensured even if the amount of Cr is no more than 0.35% (Comparative Example B-4). When the amount of Cr in the Cu phase is no more than 0.35% (Examples B-1 through B-4), the low value of contact resistance is maintained. In contrast, in Comparative Example B-2 wherein the amount of Cr in the Cu phase is more than 0.35%, the contact forming material exhibits high contact resistance characteristic.

The voltage withstanding characteristic of the Cu-Cr-base contact forming materials containing about 40% of Cr and about 10% of Co (Examples B-1 through B-4 and Comparative Example B-2) is superior, by about 20%, to that of the Cu-Cr contact forming material containing no Co (Comparative Example B-1). This tendency is also observed by comparing Examples B-5 and B-6 (the amount of Cr is from about 50% to 70%, and the amount of Co is about 10%) with Comparative Example B-3 (the Co-free material). Even if the amount of Co is about 0.11% as shown is Example B-7, the superiority is observed. In the present invention, the presence of Co and Fe in the arc-proof material is effective from the standpoint of voltage withstanding capability.

The foregoing is the description with regard to the Cu-Cr-Co contact forming material. Whe the amount of Cr in the Cu and/or Ag phases is controlled within the specific value, i.e., 0.35% by weight, similar effects can be obtained even in the cases of other Cu-Cr-base contact forming materials such as Cu-Cr-Fe, Ag-Cr-Co, and Ag-Cr-Fe as shown in Tables 3 and 4 (Examples B-8 through B-12).

TABLE 3

| Example No. and Comparative Example No. | Material Used: Composition of Cu—Cr—base contact forming material (wt. %) | Material Used: Amount of Cr contained in Cu phase portion of Cu—Cr—base contact forming material (wt. %) | Evaluation result: Temperature rise characteristic (°C.) | Evaluation result: Contact resistance characteristic (μΩ) | Evaluation result: Voltage withstanding characteristic (Comparison) |
|---|---|---|---|---|---|
| Comp. Exam. B-1 | Cu—40.7Cr | 0.01 | 49.1 | 10.2–13.3 | 1.0 |
| Exam. B-1 | Cu—40.1Cr—11.2Co | 0.01 | 48.7 | 10.1–12.7 | 1.2 |
| Exam. B-2 | Cu—39.6Cr—10.6Co | 0.07 | 51.3 | 10.2–13.0 | 1.2 |
| Exam. B-3 | Cu—40.2Cr—10.4Co | 0.16 | 56.2 | 12.2–14.0 | 1.2 |
| Exam. B-4 | Cu—40.3Cr—9.6Co | 0.35 | 64.0 | 14.8–17.0 | 1.2 |
| Comp. Exam. B-2 | Cu—39.9Cr—10.5Co | 0.52 | 75.2 | at least 25 | 1.25 |
| Comp. Exam. B-3 | Cu—61.4Cr | 0.32 | 67.3 | 15.2–18.8 | 1.0 |
| Exam. B-5 | Cu—51.6Cr—10.8Co | 0.30 | 69.0 | 16.3–19.7 | 1.2 |
| Exam. B-6 | Cu—68.2Cr—11.6Co | 0.31 | 69.4 | 18.8–20.6 | 1.25 |
| Comp. Exam. B-4 | Cu—81.9Cr—9.7Co | 0.31 | 97.0 | at least 35 | 1.3 |
| Exam. B-7 | Cu—60.6Cr—0.11Co | 0.07 | 64.3 | 16.2–19.3 | 1.2 |
| Exam. B-8 | Cu—39.2Cr—34.4Co | 0.15 | 61.4 | 15.7–17.2 | 1.2 |
| Exam. B-9 | Cu—41.9Cr—8.7Fe | 0.15 | 55.5 | 11.8–13.8 | 1.2 |
| Exam. B-10 | Cu—39.3Cr—6.2Co—4.9Fe | 0.16 | 56.0 | 11.9—13.5 | 1.2 |

TABLE 4

| Example No. | Material used: Composition of Ag—Cr—base contact forming material (wt. %) | Material used: Amount of Cr in the Ag phase portion of Ag—Cr—base contact forming material (wt. %) | Evaluation Result: Temperature rise characteristic (°C.) | Evaluation Result: Contact resistance characteristic (μΩ) | Evaluation Result: Voltage withstanding characteristic (Comparison) |
|---|---|---|---|---|---|
| Example B-11 | Ag—41.2Cr—10.1Co | 0.17 | 51.1 | 10.8–13.0 | — |
| Example B-12 | Ag—40.7Cr—9.7Fe | 0.15 | 49.7 | 10.2–12.5 | — |

As can be seen from Tables 3 and 4, in the contact forming materials of the present invention, good temperature rise characteristic and good contact resistance characteristic are obtained by controlling the amount of Cr in the highly conductive material (Cu and/or Ag phases) within the specific amount. In many cases, the lower limit of the arc-proof material is determined by other characteristics such as the consumption resistance, welding-resistance and current interrupting characteristic of the contacts. In particular, if the amount of the highly conductive materials Cu and/or Ag is less than 20%, the desired current interrupting characteristic will not be ensured. If the amount of the highly conductive materials Cu and/or Ag is more than 80%, the consumption resistance and voltage withstanding characteristic will become inadequate.

The amount of Cr and other arc-proof materials (i.e., Fe and or Co) is the balance of the highly conductive materials (Cu and/or Ag). The ratio of the Cr to the Fe and/or Co must be at least 1:1 from the standpoint of ensuring, particularly, the large capacity current interrupting performance.

In the case of the Cu and/or Ag-Cr-base contact forming material, the upper limit of the amount of Cr in the Cu and/or Ag phases is 0.35% by weight. While the lower limit of the amount of Cr in the Cu and/or Ag phases is preferably much lower, it is impossible to avoid the entrance of Cr to some extent during production (during sintering and/or during infiltration) and Cr is present inevitably in an amount of about 0.01% by weight. Thus, it is believed that such an amount is substantially the lower limit of Cr.

The amount of Al, Si and Ca in the Cr raw material has important influence on the decrease of restrike. For example, the Cr raw material used in these examples contains no more than 100 ppm of Al, no more than 22 ppm of Si and no more than 10 ppm of Ca. The effects and advantages of the present invention are greatly improved by observing the upper limit of Al, Si and Ca.

EXAMPLES C-1 THROUGH C-18 AND COMPARATIVE EXAMPLES C-1 THROUGH C-3

First, as pretreatment for producing a contact forming alloy, mixture of Cr having an average particle size of 125 micrometers and Mo (or W, or Ta, and so on) of having an average particle size of 1 to 3 micrometers are compacted under a pressure of 2 tons per square centimeter into a green compact, and the compact is placed in a carbon vessel. Preliminary sintering is carried out for one hour in vacuo at a temperature of 1,000° C. A Cu infiltrating agent is placed on the lower surface of the preliminary sinter. An infiltration step is then carried out for one hour in vacuo at a temperature of 1,200° C. After the infiltration step is completed, the contact forming alloy material is cooled from 1,200° C.

In the Cu-Cr-base contact forming materials containing about 40% by weight of Cr and about 10% by weight of Mo, the amount of Cr in the Cu phase was varied. Each of the Cu-Cr-base contact forming materials was processed into a specific contact shape, and then each alloy sample was mounted on the mountable testing device described above and subjected to the current-passing test under the specific conditions described above. As can be seen from the results shown in the following Table 5, the temperature rises with increasing the amount of Cr in the Cu phase. In particular, when the amount of Cr in the Cu phase is no more than 0.35% (Examples C-1 through C-4), the value of the temperature rise of the movable axial portion is no more than 70° C. In contrast, when the amount of Cr in the Cu phase is 0.59% (Comparative Example C-2), the value of the temperature rise exceeds 70° C. (Table 5). While it is difficult to provide the strict explanation which shows the fact that the critical value of the temperature rise is 70° C., the assembly-type switchgear used in this experiment has thermal constitution extremely similar to a conventional vacuum valve (such as the deposition of members and heat capacity) and it can be considered that a certain correspondence is obtained. That is, in the conventional vacuum valve, the temperature rise of 65° C. is regarded as a criterion. According to experimental conversion, the value of the temperature rise of 70° C. of the present mountable switchgear corresponds approximately to it.

The tendency described above is exhibited by the contacts wherein the total amount of Cr in the Cu-Cr-base contact forming material is about 40%. Even if the amount of Cr is 55.2% and the amount of Mo is about 10% (Example C-5), or even if the amount of Cr is 69.2% and the amount of Mo is about 10% (Example C-6), the stable temperature rise characteristic is observed when the amount of Cr in the Cu phase is within 0.35%. In contrast, in the case of the contact forming alloy wherein the total amount of Cr in the Cu-Cr-base contact forming material is 80.7% and wherein the amount of Mo is about 10% (Comparative Example C-3), the stable temperature characteristic cannot be ensured even if the amount of Cr is no more than 0.35% (Comparative Example C-3). When the amount of Cr in the Cu phase is no more than 0.35% (Example C-1 through C-4), the low value of contact resistance is maintained. In contrast, in Comparative Example C-2 wherein the amount of Cr in the Cu phase is more than 0.35%, the contact forming material exhibits high contact resistance characteristic.

The voltage withstanding characteristic of the Cu-Cr-base contact forming materials containing about 40% of Cr and about 10% of Mo (Examples C-1 through C-4 and Comparative Example C-2) is superior, by about 30%, to that of the Cu-Cr contact forming material containing no Mo (comparative Example C-1). This tendency is also observed by comparing Examples C-5 and C-6 (the amount of Cr is from about 50% to 70%, and the amount of Mo is about 10%) with Comparative Example C-1. Even if the amount of Co is about 0.1% as shown in Example C-7, the superiority is observed. In the present invention, the presence of Mo in the arc-proof material is effective from the standpoint of voltage withstanding capability. The presence of Mo in the arc-proof material is also effective in the case of the Cu-Cr-base contact forming material containing a larger amount of Mo as shown in Example C-9 (Table 5).

The foregoing is the description with respect to the Cu-Cr-Mo contact forming materials. When the amount of Cr in the Cu and/or Ag phases is controlled within the specific value, i.e., 0.35% by weight, similar effects can be obtained even in the cases of other Cu-Cr-base contact forming materials such as Cu-Cr-W (Example C-10), and Cu-Cr-Ta (Example C-13) as shown in Table 6 (Examples C-10 through C-18).

Further, even if Ag is used as the highly conductive material, similar effects are obtained when the amount of Cr in the Ag phase is controlled within the specific amount (Examples C-17 and C-18).

TABLE 5

| | Material used | | Evaluation result | | |
|---|---|---|---|---|---|
| Example No. and Comparative Example No. | Composition of Cu—Cr—base contact forming material (wt %) | Amount of Cr in the Cu and/or phase portions of Cu—Cr—base contact forming material (wt %) | Temperature rise characteristic (°C.) | Contact resistance characteristic (μΩ) | Voltage withstanding characteristic (Comparison) |
| Comp. Exam. C-1 | Cu—40.7Cr | 0.01 | 49.1 | 10.2–13.3 | 1.0 |
| Exam. C-1 | Cu—38.7Cr—11.6Mo | 0.01 | 49.3 | 10.7–12.9 | 1.3 |
| Exam. C-2 | Cu—39.2Cr—9.8Mo | 0.06 | 52.1 | 11.2–13.6 | 1.3 |
| Exam. C-3 | Cu—40.6Cr—10.6Mo | 0.15 | 59.2 | 13.3–15.0 | 1.3 |
| Exam. C-4 | Cu—39.8Cr—10.5Mo | 0.35 | 65.3 | 15.9–18.1 | 1.3 |
| Comp. Exam. C-2 | Cu—40.5Cr—11.1Mo | 0.59 | 77.7 | at least 30 | 1.35 |
| Exam. C-5 | Cu—55.2Cr—10.2Mo | 0.32 | 69.2 | 17.7–18.6 | 1.35 |
| Exam. C-6 | Cu—69.2Cr—10.9Mo | 0.30 | 69.7 | 18.3–20.7 | 1.35 |
| Comp. Exam. C-3 | Cr—80.7Cr—9.3Mo | 0.31 | 103.0 | at least 50 | 1.35 |
| Exam. C-7 | Cu—40.5Cr—0.1Mo | 0.16 | 54.7 | 12.3–13.1 | 1.3 |
| Exam. C-8 | Cu—41.1Cr—21.3Mo | 0.15 | 60.2 | 13.7–15.9 | 1.3 |
| Exam. C-9 | Cu—40.8Cr—34.5Mo | 0.16 | 69.5 | 17.9–19.2 | 1.3 |

TABLE 6

| | Material used | | Evaluation result | | |
|---|---|---|---|---|---|
| Example No. | Composition of Cu—Cr—base contact forming material (wt. %) | Amount of Cr contained in Cu and/or Ag phase portions of Cu—Cr—base contact forming material (wt %) | Temperature rise characteristic (°C.) | Contact resistance characteristic (μΩ) | Voltage withstanding characteristic (Comparison) |
| Exam. C-10 | Cu—42.0Cr—9.3W | 0.17 | 60.7 | 14.2–16.3 | 1.35 |
| Exam. C-11 | Cu—41.3Cr—10.1V | 0.15 | 61.2 | 16.8–18.4 | " |
| Exam. C-12 | Cu—41.7Cr—9.7Nb | 0.16 | 60.9 | 15.2–17.7 | " |
| Exam. C-13 | Cu—40.6Cr—11.3Ta | 0.15 | 61.6 | 16.1–18.5 | " |
| Exam. C-14 | Cu—40.2Cr—4.7W—5.9Mo | 0.16 | 60.3 | 15.1–16.9 | " |
| Exam. C-15 | Cu—39.4Cr—6.3Nb—4.6Ta | 0.15 | 62.4 | 16.1–17.9 | " |
| Exam. C-16 | Cu—41.2Cr—5.6V—5.7Ta | 0.17 | 61.9 | 16.6–17.3 | " |
| Exam. C-17 | Ag—42.1Cr—10.0Mo | 0.17 | 49.2 | 10.1–12.1 | — |
| Exam. C-18 | Ag—41.3Cr—10.7W | 0.16 | 51.2 | 11.1–12.4 | — |

As can be seen from Tables 5 and 6, in the contact forming materials of the present invention, good temperature rise characteristic and good contact resistance characteristic are obtained by controlling the amount of Cr in the highly conductive material (Cu and/or Ag phases) within the specific amount. In many cases, the lower limit of the arc-proof material is determined by other characteristics such as the consumption resistance, welding-resistance and current interrupting characteristic of the contacts. In particular, if the amount of the highly conductive materials Cu and/or Ag is less than 20%, the desired current interrupting characteristic will not be ensured. If the amount of the highly conductive materials Cu and/or Ag is more than 80%, the consumption resistance and voltage withstanding characteristic will become inadequate.

The amount of Cr and other arc-proof marterials (i.e., W, Mo, V, Nb and Ta) is the balance of the highly conductive materials (Cu and/or Ag). The ratio of the Cr to at least one of W, Mo, V, Nb and Ta must be at least 1:1 from the standpoint of ensuring, particularly, the large capacity current interrupting performance.

In the case of the Cu and/or Ag-Cr-base contact forming materials, the upper limit of the amount of Cr in the Cu and/or Ag phases is 0.35% by weight. While the lower limit of the amount of Cr in the Cu and/or Ag phases is preferably much lower, it is impossible to avoid the entrance of Cr to some extent during production (during sintering and/or during infiltration) and Cr is present inevitably in an amount of about 0.01% by weight. Thus, it is believed that such an amount be substantially the lower limit of Cr.

The amount of Al, Si and Ca in the Cr raw material has important influence on the decrease of restrike. For example, the Cr raw material used in these examples contains no more than 100 ppm of Al, no more than 20 ppm of Si and no more than 10 ppm of Ca. The effects and advantages of the present invention are greatly improved by observing the upper limit of Al, Si and Ca.

What is claimed is:

1. A contact forming material for a vacuum valve or vacuum circuit breaker comprising:

(a) a conductive material matrix, consisting of at least one of the group consisting of copper, silver and mixtures thereof; and (b) an arc-proof material consisting of at least one metal selected from the group consisting of chromium, titanium, and zirconium, and alloys of these metals with at least one other metal, wherein the amount of said arc-proof material in the form of a solid solution present in said conductive material matrix is no more than 0.35% by weight of the conductive material.

2. The material according to claim 1, wherein the amount of said arc-proof material in the form of a solid solution present in the matrix of said conductive material matrix is from 0.01% to 0.35% by weight of the conductive material.

3. The material according to claim 1, wherein said arc-proof material comprises a chromium-base alloy containing no more than 50% by weight of at least one metal selected from the group consisting of iron and cobalt, and the balance being chromium.

4. The material according to claim 3, wherein a new material of the chromium contains no more than 10 ppm of aluminum, no more than 20 ppm of silicon, no more than 10 ppm of vanadium, and no more than 10 ppm of calcium.

5. The material according to claim 1, wherein said arc-proof material comprises a chromium-base alloy containing no more than 50% by weight of at least one metal selected from the group consisting of molybdenum, tungsten, vanadium, niobium and tantalum, and the balance being chromium.

6. The material according to claim 5, wherein the chromium raw material contains no more than 10 ppm of aluminum, no more than 20 ppm of silicon, and no more than 10 ppm of calcium.

7. The material according to claim 1, wherein the total amount of arc-proof material present in said contact forming material ranges from 20–80% by weight of the contact forming material.

* * * * *